US008024905B2

(12) United States Patent
Cave

(10) Patent No.: US 8,024,905 B2
(45) Date of Patent: Sep. 27, 2011

(54) STRUCTURAL REINFORCEMENT SYSTEM FOR CONCRETE STRUCTURES

(76) Inventor: Thomas Cave, Frenchlick, IN (US)

( * ) Notice: Subject to any disclaimer, the term of this patent is extended or adjusted under 35 U.S.C. 154(b) by 46 days.

(21) Appl. No.: 12/460,665

(22) Filed: Jul. 22, 2009

(65) Prior Publication Data

US 2010/0101179 A1 Apr. 29, 2010

Related U.S. Application Data

(60) Provisional application No. 61/197,182, filed on Oct. 24, 2008.

(51) Int. Cl.
*E04G 21/00* (2006.01)

(52) U.S. Cl. ..... 52/741.15; 52/742.14; 52/294; 52/414; 52/169.9; 264/35

(58) Field of Classification Search ..... 52/414, 52/742.14, 742.11, 601, 600, 741.15, 294, 52/295, 299, 169.9; 404/135, 136, 134, 82, 404/70, 72, 17; 264/31, 35
See application file for complete search history.

(56) References Cited

U.S. PATENT DOCUMENTS

| | | | | |
|---|---|---|---|---|
| 407,500 | A * | 7/1889 | Vaughan | 52/169.1 |
| 1,637,742 | A * | 8/1927 | Edge et al. | 52/685 |
| 2,883,852 | A * | 4/1959 | Midby | 52/236.8 |
| 4,886,399 | A * | 12/1989 | Pidgeon | 405/229 |
| 5,421,136 | A * | 6/1995 | Van De Peer | 52/294 |
| 5,564,235 | A * | 10/1996 | Butler | 52/126.6 |
| 6,101,779 | A * | 8/2000 | Davenport | 52/602 |
| 6,161,360 | A * | 12/2000 | Smith | 52/678 |
| 6,178,710 | B1 * | 1/2001 | Colalillo | 52/310 |
| 6,269,602 | B1 * | 8/2001 | Thooft et al. | 52/299 |
| 6,550,213 | B1 * | 4/2003 | Butler | 52/741.15 |
| 7,028,445 | B2 * | 4/2006 | Camilleri | 52/742.14 |
| 2001/0023563 | A1 * | 9/2001 | Phillips | 52/292 |
| 2004/0148885 | A1 * | 8/2004 | Femminella | 52/319 |
| 2010/0107536 | A1 * | 5/2010 | Tautari et al. | 52/414 |

FOREIGN PATENT DOCUMENTS

| | | | |
|---|---|---|---|
| JP | 62090445 | A * | 4/1987 |
| JP | 04353124 | A * | 12/1992 |

* cited by examiner

*Primary Examiner* — Robert Canfield
*Assistant Examiner* — Babajide Demuren
(74) *Attorney, Agent, or Firm* — Gary K. Price

(57) ABSTRACT

A structural reinforcement system that is implemented during the preparation of the area when pouring a concrete slab such as, but not limited to, commercial and residential floors, patios and driveways. The system includes digging foundation holes that are selectively disposed around the area being poured. The system further includes positioning steel bars above the ground in the lower twenty-five percent (25%), rather than upper fifty percent (50%) as known in the prior art, of the concrete being poured. In this manner, the poured concrete encapsulates the lattice in the lower twenty-five percent (25%) of the concrete when it hardens. As a result, the system improves and often removes the possibility of any cracks in the concrete and eliminates the need for saw joints. In addition, due to the stability created with the addition of strategically placed foundation holes, less concrete is required on the job resulting in a significant cost savings.

20 Claims, 5 Drawing Sheets

STRUCTURAL REINFORCEMENT SYSTEM FOR CONCRETE STRUCTURES

CROSS REFERENCES TO RELATED APPLICATIONS

U.S. Provisional Application for Patent No. 61/197,182, filed Oct. 24, 2008, with title "Structural Reinforcement System for Concrete Structures" which is hereby incorporated by reference. Applicant claims priority pursuant to 35 U.S.C. Par. 119(e)(i).

Statement as to rights to inventions made under federally sponsored research and development: Not Applicable

BACKGROUND OF THE INVENTION

1. Field of the Invention

The present invention is generally directed a structural reinforcing method used in pouring concrete. More particularly, the invention is directed to a structural reinforcement system implemented prior to pouring concrete to form a concrete slab.

2. Brief Description of Prior Art

Concrete has proven to be the preferred material for the construction in many applications including commercial and residential floors, patios, driveways and the like. In such applications, however, concrete invariably develops cracks throughout the length of the concrete structure caused by the curing process, load induced stress, weather conditions and other causes so that the life cycle of the concrete can become severely reduced.

Uncontrolled, visible cracks in concrete slabs are generally perceived by those observing as unsightly at best and as failures at worst. Furthermore, the uncontrolled cracks represent weak regions, which may fail under load.

Traditional methods involved in placing a concrete slab include excavating and preparing the base where the concrete slab will be situate. In the prior art, a standard sub-grade thickness may be 4 inches and it is key that the sub-grade maintain an even thickness throughout the width and length. Steel bars are typically used to provide structural support to the concrete. In slab applications, the bars are usually arranged in a rectangular lattice which is supported some distance above the ground or other surface on which the slab is to be poured. In this regard, it is known to place the bars above the ground or other surface on which the slab is to be poured in the upper fifty percent (50%) of the concrete being poured. In this manner, the concrete may flow under and around the lattice, thereby encapsulating the lattice in the upper fifty percent (50%) of the concrete when it hardens. However as previously discussed, the concrete will invariably develop cracks thereby reducing its life cycle.

To the best knowledge of the applicant, a suitable, commercially practicable method has not been found for the preparation of the sub-grade when pouring a concrete slab that significantly avoids the cracking and structurally supports the life cycle of the resulting concrete slab.

As will be seen from the subsequent description, the preferred embodiments of the present invention overcome shortcomings of the prior art.

SUMMARY OF THE INVENTION

Briefly stated, the present invention is directed to a structural reinforcement system that is implemented during the preparation of the sub-grade when pouring a concrete slab such as, but not limited to, commercial and residential floors, patios and driveways.

The instant method and system of slab construction teach away from traditional approaches used to reinforce a concrete slab. As opposed to traditional methods of increasing the size and/or depth of the ground base where the concrete slab will be situate, the present invention teaches digging foundation holes that are selectively disposed around the base area to be poured. Not wishing to be bound by tradition or theory, the present method further includes positioning steel forms or bars above the ground or other surface on which the slab is to be poured in the lower twenty-five percent (25%), rather than upper fifty percent (50%) as known in the prior art, of the concrete being poured. In this manner, the poured concrete encapsulates the lattice in the lower twenty-five percent (25%) of the concrete when it hardens. As a result, the inventor has found that this system improves and often removes the possibility of any cracks in the concrete and eliminates the need for saw joints as is known. In addition, due to the stability created with the addition of strategically placed foundation holes, the inventor has found you can use less concrete on a job resulting in a significant cost savings. For example, the inventor has found that instead of pouring a 4" slab, you can successfully pour a 3" slab using the method of the present invention resulting in an approximate twenty-five percent (25%) savings in material.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are present preferred. It should be understood, however, that the invention is not limited to the precise arrangements and instrumentalities shown.

In the drawings.

DESCRIPTION OF THE PREFERRED EMBODIMENT

Figure 1:
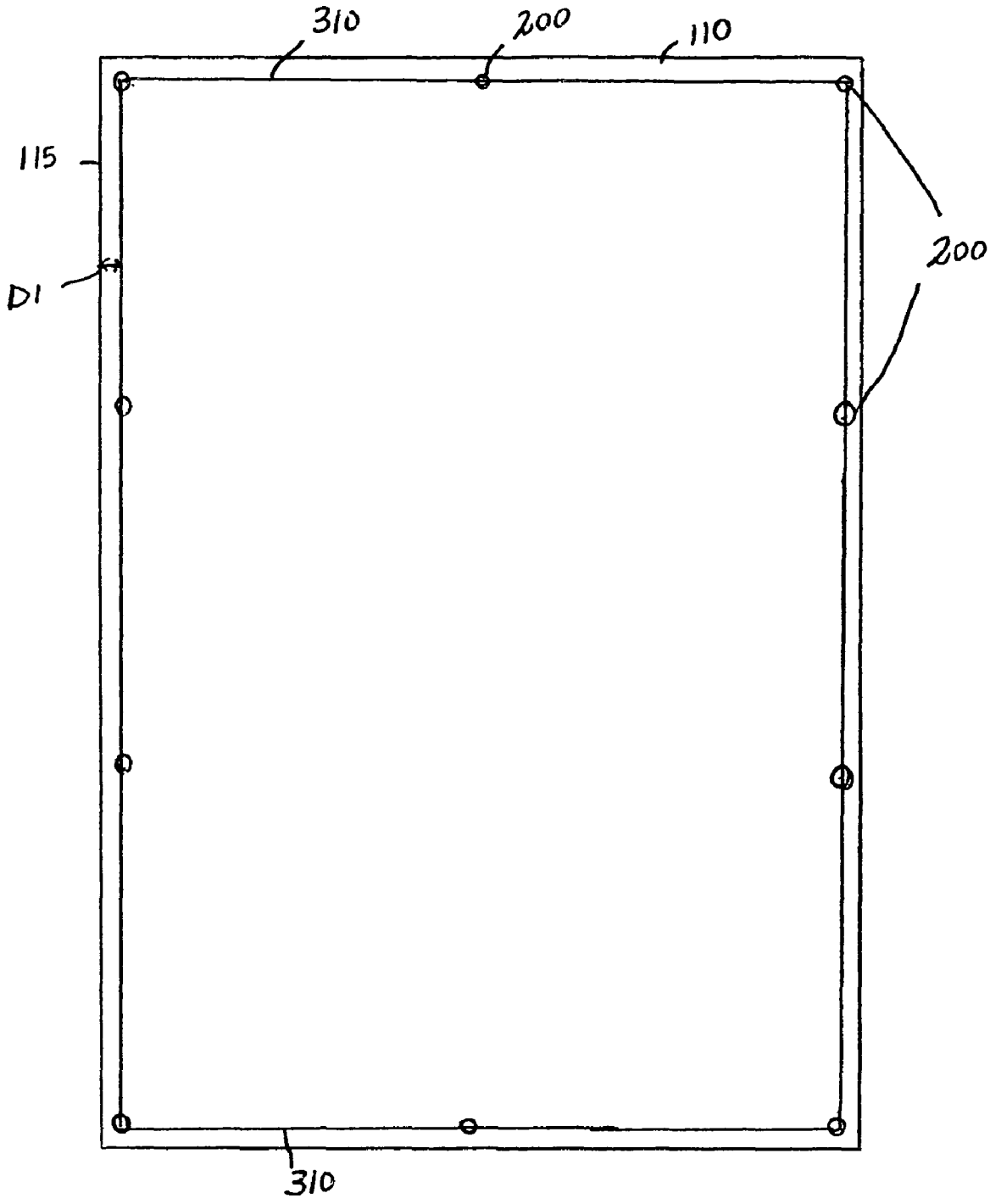
FIGS. 1-4 are detailed top plan views of a structural reinforcement system for concrete structures, according to the preferred embodiment of the present invention.
Figure 2:
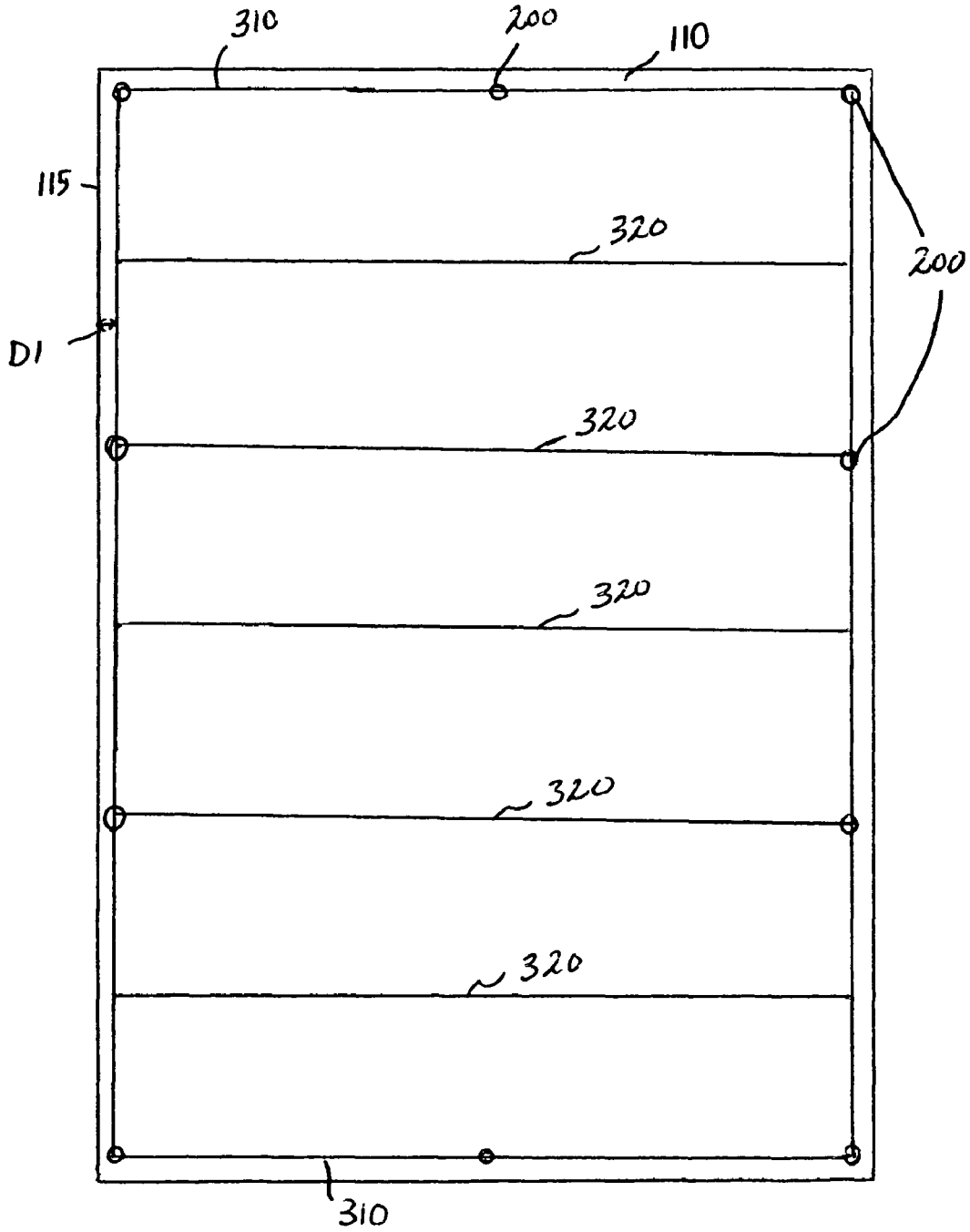
Figure 3:
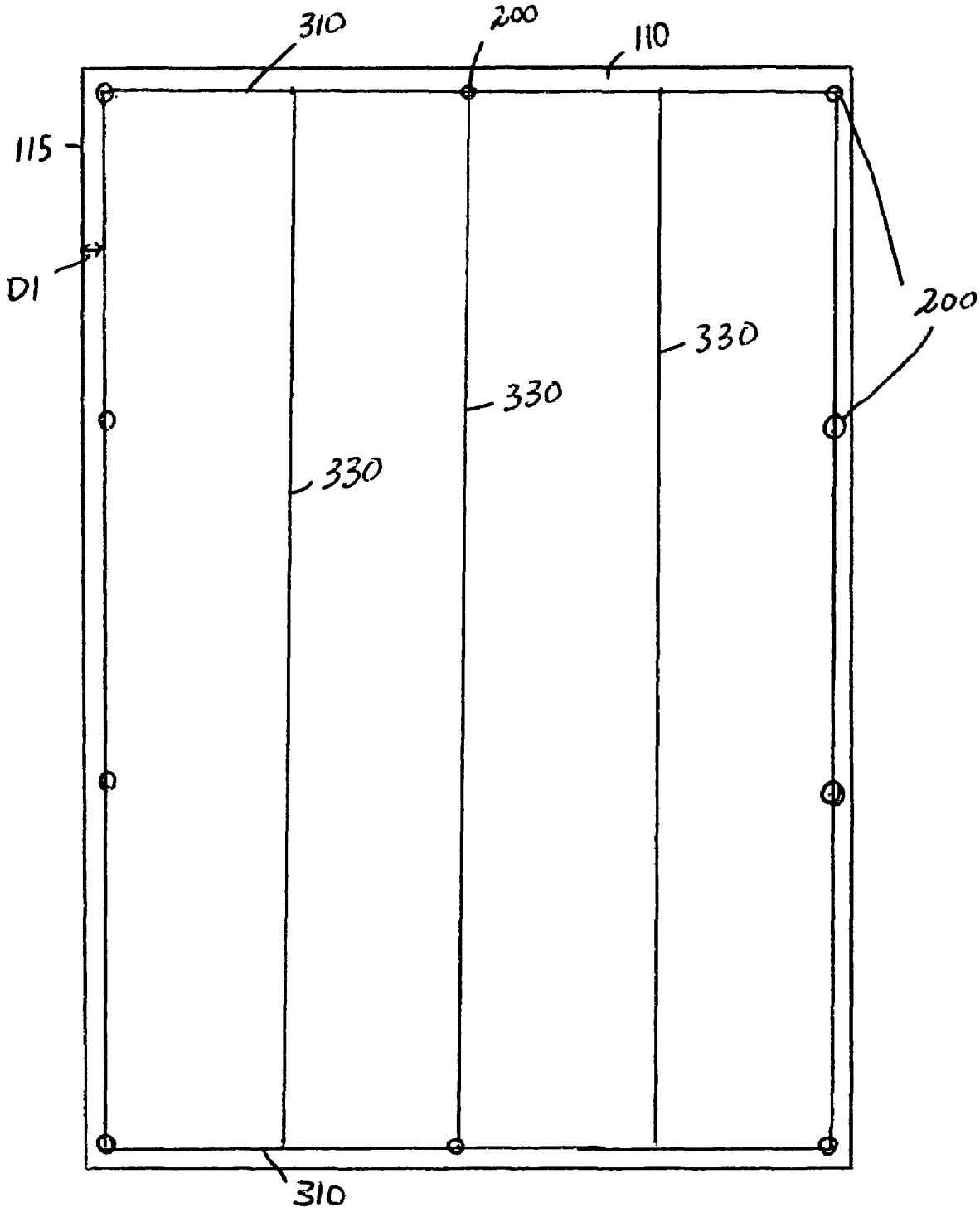

In accordance with the present invention, a structural reinforcement system for concrete structures is disclosed. More particularly, the disclosed system relates to a method used in the construction of many applications including commercial and residential floors, patios, driveways, and the like. Specifically, it will be noted in the following description that the present disclosure relates to a system that results in an end product that improves and often removes the possibility of cracks in the concrete and eliminates the need for saw joints as is known. In addition, due to the stability created with the addition of strategically placed foundation holes, the inventor has found you can use less concrete on a job resulting in a significant cost savings.

In the broadest context, the process consists of components and steps configured with respect to each other so as to attain the desired objective.

In general, the structural reinforcing method of the present invention uses many of the conventional steps currently used in pouring concrete. These conventional steps include, the step of excavating and preparing the base where the concrete slab will be situate, laying steel forms or bars to provide structural support to the concrete, and pouring the concrete. However there are clear distinctions between the present method and the method of prior art.

Referring to the drawings, the structural reinforcing method of the present invention for preparing the area for pouring concrete is as follows:

1. Excavating Step 100. The step 100 of excavating a subject area 110 is very similar to prior art except that, and as will be understood, the depth required to excavate will be less since the present invention requires less concrete material. For example, the inventor has found that instead of pouring a 4" slab, you can successfully pour a 3" slab using the method of the present invention resulting in an approximate twenty-five percent (25%) savings in material.

Figure 4:
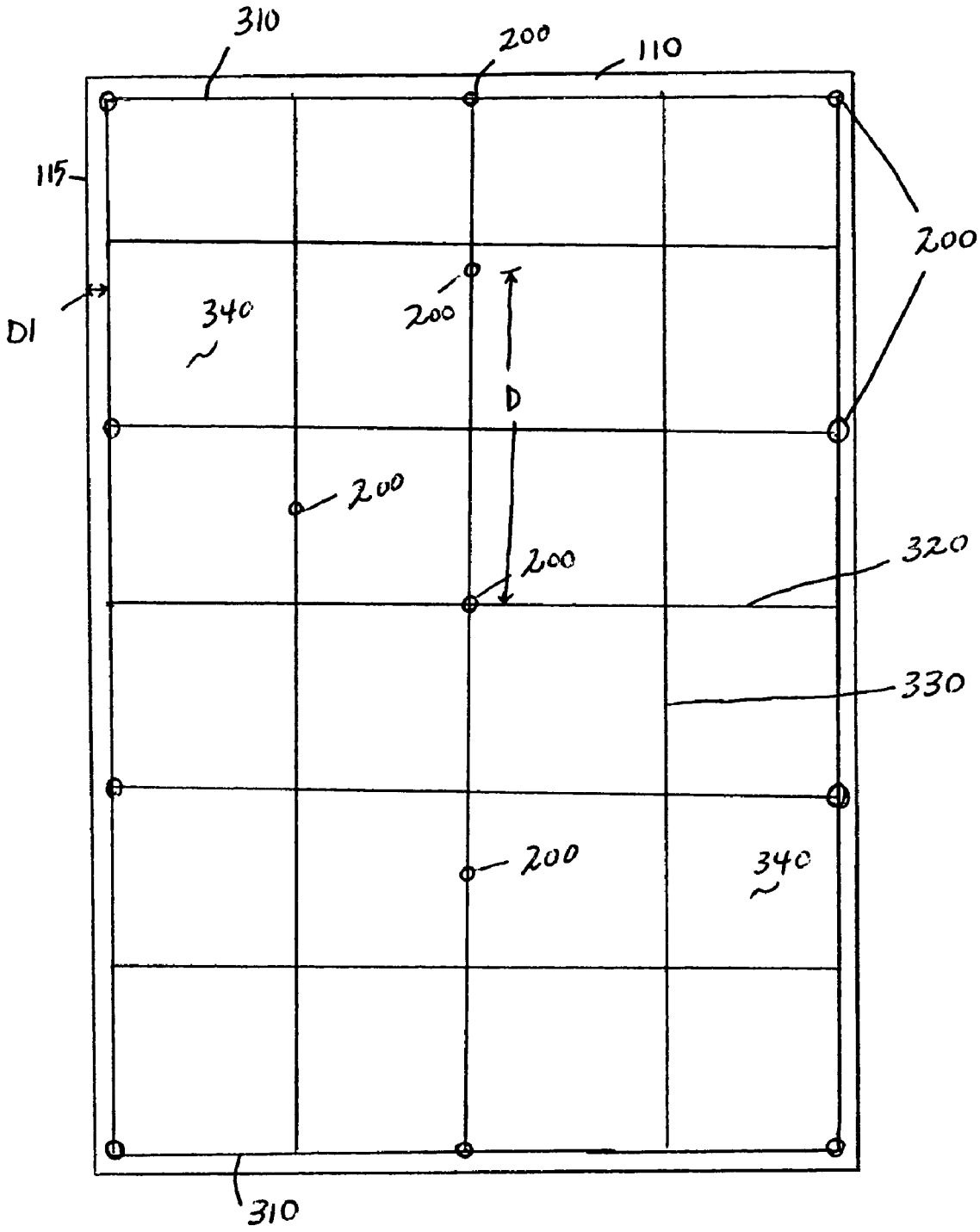
Figure 5:
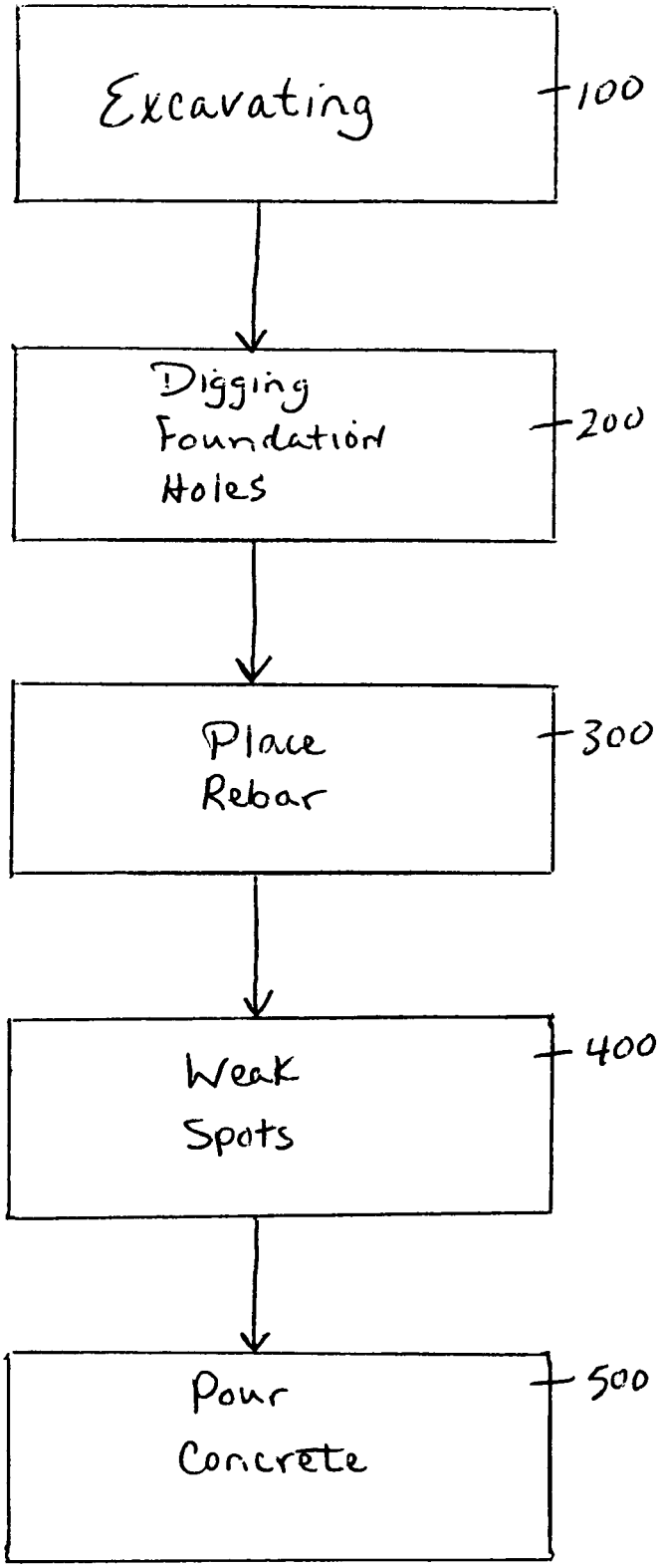
FIG. 5 is a diagram illustrating the steps of the system illustrated in FIGS. 1-4.

2. Step of Digging Foundation Holes 200. Strategically place/dig foundation holes 200 having an approximate 6" diameter, and 18" deep or below the freeze level in the particular region whichever is greater, around the area 110 being poured. Each foundation hole 200 is 18" (or below freeze level) from the top of the poured concrete in order to be below frost level thereby creating a stabilization of the concrete poured and also strengthening the poured concrete as well. Each foundation hole 200 is positioned a distance "D" (shown in FIG. 4) apart from the other. Preferably, for slabs 30'×40' or greater, the foundation holes 200 are positioned a distance of approximately 10' apart. For smaller slabs, the foundation holes 200 are preferably positioned a distance of approximately 5' apart. As will be understood the foundation holes 200, when filled with concrete creates strong points over the entire area of the concrete slab.

3. Rebar Placement Step 300. A perimeter bar 310 is placed a distance "D1" of approximately 6" from an outer edge 115 of the concrete area 110, completely around the perimeter of the area 110. First connecting bars 320 are placed across the width of the concrete area 110 and appropriately attached to the perimeter bar 310. The first connecting bars 320 are each preferably placed a distance between 3'-5' apart. Then, second connecting bars 330 are placed along the length of the area 110, opposite the first connecting bars 320, and attached to the perimeter bar 310, forming a lattice of small mini-squares 340. The second connecting bars 330 each preferably placed a distance between 3'-5' apart. The bars 310, 320, 330 are placed above the ground surface in the lower twenty-five percent (25%) of the concrete being poured, approximately 1" from grade. When placing the first and second connecting bars 320, 330 as described, it is critical that the bars 320, 330 are placed over the entire area 110 including the foundation holes 200. While it is not as critical that all the foundation holes intersect with bars, the more foundation holes covered the better.

The connecting bars 320, 330 are tied together with verticals known in the art such that each vertical is driven into the center of each of the foundation holes 200. When this is completed, we have bars formed to the width of the slab and placed approximately 1" above the ground surface using chairs or baskets known in the art, which should be the lower third to twenty-five percent (25%) of the concrete when poured. As previously described, this is critical to the present method and distinguishable over prior art methods.

4. Locating Potential Weak Spots 400. Once the Rebar Placement Step 300 is completed as described, the user should visually consider potential weak spots 400 in the concrete slab. For example, in a post building where a concrete floor is being poured, weak spots are likely between the upright column posts which hold the structure up. First of all, placement of bars 320, 330 should not be in alignment between these upright column posts. A minimum of 1' to 18" off center of each post is preferred leaving a space from post to post with no bars. In those areas it is preferred to thicken the slab an additional inch (from 3" slab to 4" slab for example) by additional grading at those selected locations. By thickening the slab in between the posts as described, instead of having weak spots, such locations become strong points that eliminate possible cracks. It is also preferred to thicken the slab as discussed around floor drain areas as well.

The inventor has found that adding foundation holes as described and selectively thickening the slab in potentially weak areas as described normally takes a minimal amount of concrete. Approximately one-half yard of concrete will pour 50 holes and support areas. A pour that normally takes 20 yards of concrete, requires only 15 yards plus approximately 1 extra yard for the holes resulting in material savings.

5. Pouring Concrete Step 500. The step 500 of pouring concrete is very similar to prior art except that, and as discussed, less concrete material is required. Using the method of the present invention generally results in an approximate twenty-five percent (25%) savings in medical generally.

EXAMPLE

A specific example of slab construction will now be described. The inventor applied the present invention to a job (a grain bin) that when using prior art methods would normally require 38-40 yards of concrete for a deep, thickened outside footer and a full 6" floor. In applications requiring larger volumes of material such as a grain bin, the present method reduces cost significantly. Using the present method as described required approximately 8 yards of concrete resulting in a large savings in material and, further resulting in a higher quality concrete floor product.

Some of the advantages of the structural reinforcement system for concrete structures can be summarized as follows:

Application of the foundation holes below frost line, keeps the concrete slab stable and keeps it from moving up and down;

At least an approximate twenty-five percent (25%) savings in material;

Skilled labor is not required to install the present system;

There is minimal and generally no risk of cracks forming in concrete slabs;

Eliminates the need for working expansion joints and saw joints as known;

Conventional machinery can be used;

There are significant reductions in construction time and cost produced by each of the above.

Although the description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

I claim:

1. A structural reinforcement method used in pouring concrete comprising the following steps in the order named:

excavating an area for pouring a concrete slab, digging a plurality of foundation holes in said area, placing a perimeter bar around said area's perimeter, placing a plurality of first connecting bars across said area's width and attaching ends of said first connecting bars to said perimeter bar, placing a plurality of second connecting bars across said area's length and attaching ends of said second connecting bars to said perimeter bar, tying said first and second connecting bars together with verticals, and wherein each said vertical is driven into the center of each of said foundation holes, pouring concrete into said area such that the concrete encapsulates said perimeter bar and said first and second connecting bars, wherein said first and second connecting bars are positioned in the lower third to 25% of the concrete when poured.

2. The method as recited in claim 1, wherein said first and second connecting bars form a lattice of small mini-squares.

3. The method as recited in claim 1, further including the step of grading said area an additional 1 inch at visually considered weak spots in said area.

4. The method as recited in claim 1, wherein each of said foundation holes having an approximate 6" diameter and having a depth of about 18 inches.

5. The method as recited in claim 4, wherein each of said foundation holes are positioned a distance of about 5 to 10 feet apart.

6. The method as recited in claim 1, wherein said perimeter bar is positioned approximately 6" from an outer edge of said area.

7. The method as recited in claim 1, wherein said first connecting bars are each placed a distance between 3'-5' apart.

8. The method as recited in claim 7, wherein said second connecting bars are each placed a distance between 3'-5' apart.

9. A structural reinforcement method used in pouring concrete comprising the following steps in the order named:

excavating an area for pouring a concrete slab, digging a plurality of foundation holes in said area, wherein each of said foundation holes having an approximate 6" diameter and having a depth of about 18 inches, placing a perimeter bar adjacent an outer edge of said area, placing a plurality of first connecting bars across said area's width and attaching ends of said first connecting bars to said perimeter bar, placing a plurality of second connecting bars across said area's length and attaching ends of said second connecting bars to said perimeter bar, tying said first and second connecting bars together with verticals, and wherein each said vertical is driven into the center of each of said foundation holes, pouring concrete into said area such that the concrete encapsulates said perimeter bar and said first and second connecting bars, wherein said first and second connecting bars are placed approximately 1" above said area's ground surface.

10. The method as recited in claim 9, further including the step of grading said area an additional 1 inch at visually considered weak spots in said area.

11. The method as recited in claim 9, wherein said perimeter bar is positioned approximately 6" from an outer edge of said area and completely around said area's perimeter.

12. The method as recited in claim 9, wherein each of said foundation holes are positioned a distance of about 5 to 10 feet apart.

13. The method as recited in claim 12, wherein said first connecting bars are each placed a distance between 3'-5' apart.

14. The method as recited in claim 13, wherein said second connecting bars are each placed a distance between 3'-5' apart.

15. A structural reinforcement method used in pouring concrete comprising the following steps:

digging a plurality of foundation holes in an excavated area where a concrete slab will be situate, placing a perimeter bar around said area's perimeter, laying first connecting bars across said area width, and connecting ends of said first connecting bars to said perimeter bar, laying second connecting bars across said area length, and connecting ends of said second connecting bars to said perimeter bar, tying said first and second connecting bars to a plurality of verticals, wherein each said vertical is driven into the center of each of said foundation holes, pouring concrete into said area such that the concrete encapsulates said perimeter and connecting bars, wherein said first and second connecting bars are positioned in the lower third to 25% of the concrete when poured.

16. The method as recited in claim 15, further including the step of grading said area an additional 1 inch at visually considered weak spots in said area.

17. The method as recited in claim 15, wherein said perimeter bar is positioned approximately 6" from an outer edge of said area.

18. The method as recited in claim 17, wherein each of said foundation holes are positioned a distance of about 5 to 10 feet apart.

19. The method is recited in claim 18, wherein said foundation holes are approximately 18" deep.

20. The method as recited in claim 15, wherein said first and second connecting bars are placed approximately 1" above the ground surface.

* * * * *